US005257776A

United States Patent [19]

Suya et al.

[11] Patent Number: 5,257,776

[45] Date of Patent: * Nov. 2, 1993

[54] DEVICE FOR FEEDING SHEETS HAVING A DETECTING MEANS FOR DETECTING MISFEEDS

[75] Inventors: Toshihiro Suya; Nobuyuki Torisawa; Norikazu Soga; Issy Matsuda, all of Minamiashigara, Japan

[73] Assignee: Fuji Photo Film Co., Ltd., Kanagawa, Japan

[ * ] Notice: The portion of the term of this patent subsequent to Aug. 11, 2009 has been disclaimed.

[21] Appl. No.: 872,137

[22] Filed: Apr. 22, 1992

Related U.S. Application Data

[63] Continuation of Ser. No. 630,618, Dec. 20, 1990, Pat. No. 5,137,268.

[30] Foreign Application Priority Data

Jan. 12, 1990 [JP] Japan ..... 2-5391
Jun. 26, 1990 [JP] Japan ..... 2-168044

[51] Int. Cl.[5] ..... B65H 5/08; B65H 3/46

[52] U.S. Cl. ..... 271/11; 271/104; 271/106; 271/258; 271/262

[58] Field of Search ..... 271/11, 90, 104, 106, 271/226, 262, 263, 258, 259, 10

[56] References Cited

U.S. PATENT DOCUMENTS 3,826,485 7/1974 Shindo ..... 271/106
3,993,303 11/1976 Riedl et al. ..... 271/263
4,428,793 1/1984 Sato et al. ..... 271/106 X
4,936,566 6/1990 Hiramatsu ..... 271/259 C
5,048,811 9/1991 Hochbein ..... 271/106 X
5,064,183 11/1991 Nishigaki et al. ..... 271/10

FOREIGN PATENT DOCUMENTS 50669 11/1980 Japan .
252543 12/1985 Japan ..... 271/106

*Primary Examiner*—Robert P. Olszewski
*Assistant Examiner*—Boris Milef
*Attorney, Agent, or Firm*—Sughrue, Mion, Zinn, Macpeak & Seas

[57] ABSTRACT

Sheets such as photographic films are fed one by one by suction cups in an image recording system. A resilient sheet separator is brought into abutment against an uppermost one of stacked sheets, and then the suction cups are moved toward the uppermost sheet. Before the suction cups reach the uppermost sheet, they are activated to attract the uppermost sheet under suction. The sheet separator pushes the uppermost sheet in one direction and the suction cups draw the uppermost sheet in the opposite direction, so that the attracted uppermost sheet is greatly flexed fully out of contact with the next sheet of the sheet stack. Thereafter, the suction cups and the sheet separator are displaced away from the sheet stack, separating the uppermost sheet from the sheet stack. A detecting arrangement detects whether the suction cup attracts a single sheet. The detecting arrangement includes a detecting rod for abutting against the uppermost sheet attracted by the suction cup, and a sensor energizable by the detecting rod.

1 Claim, 11 Drawing Sheets

DEVICE FOR FEEDING SHEETS HAVING A DETECTING MEANS FOR DETECTING MISFEEDS

This is a continuation of application Ser. No. 07/630,618 filed Dec. 20, 1990, now U.S. Pat. No. 5,137,268.

BACKGROUND OF THE INVENTION

1. Field of the Invention

The present invention relates to a method of and a device for feeding sheets, one by one, from a stack of sheets stored in a magazine.

2. Prior Art

In order to deliver either unexposed photographic photosensitive mediums (e.g., a sheet such as a photographic film) from a supply magazine to an exposure station or exposed photographic photosensitive mediums to a developing machine, there is employed a sheet feeding device for taking out the photographic photosensitive mediums one by one.

The sheet feeding device typically comprises a plurality of suction cups or pads which are pressed against an uppermost photographic photosensitive medium and hold it under suction when a vaccum is created by a vaccum generator coupled to the suction cups.

When the suction cups are pressed against the uppermost photographic photosensitive medium, the pressure is also applied to remaining photographic photosensitive mediums that are stacked below the uppermost photographic photosensitive medium attracted under suction by the suction cups. The pressure thus applied tends to force out air from between the stacked photographic photosensitive mediums, so that the photographic photosensitive mediums adhere more intimately. As a result, when only the uppermost photographic photosensitive medium is to be taken from the stack, some other adhering photographic photosensitive mediums therebeneath also tend to be removed from the stack under the vacuum developed in the suction cups. Accordingly, a plurality of photographic photosensitive mediums are undesirably fed simultaneously from the supply magazine.

SUMMARY OF THE INVENTION

It is a major object of the present invention to provide a method of and a device for reliably feeding stacked photographic photosensitive mediums one by one, successively from an uppermost photographic photosensitive medium.

According to the present invention, there is provided a method of feeding sheets one by one, comprising the steps of bringing a sheet separator into abutment against an uppermost one of stacked sheets, moving a suction cup toward the uppermost sheet, attracting the uppermost sheet to the suction cup, thereby to flex the uppermost sheet, and thereafter displacing the sheet separator and the suction cup in unison with each other to separate the uppermost sheet away from the stacked sheets.

The method further includes the step of applying a resilient force from the sheet separator and a suction force from the suction cup to the uppermost sheet in respective opposite directions, to thereby flex the uppermost sheet. Moreover, the method additionally includes the steps of displacing the sheet separator and the suction cup, which is activated, toward the uppermost sheet, and temporarily stopping the sheet separator and the suction cup when the suction cup attracts the uppermost sheet at a predetermined position.

According to the present invention, there is also provided a device for feeding sheets one by one, comprising a suction cup for attracting an uppermost one of stacked sheets in a position near the stacked sheets, and sheet separating means, disposed outwardly of the suction cup, for contacting an end of the uppermost sheet and separating the uppermost sheet from remaining sheets.

The device also includes an arm on which the suction cup and the sheet separating means are fixedly mounted, the arm being displaceable to feed the uppermost feed attracted by the suction cup toward a predetermined position. The sheet separating means may comprise a resilient member, or a resilient member and a rod engaged by the resilient member and normally urged thereby to move toward the uppermost sheet.

The suction cup has a curved end surface for contact with the uppermost sheet.

According to the present invention, there is also provided a device for feeding sheets one by one, comprising a suction cup for attracting an uppermost one of stacked sheets in a position near the stacked sheets, sheet separating means for contacting an end of the uppermost sheet and separating the uppermost sheet from remaining sheets, and air blowing means for introducing air between the uppermost sheet attracted by the suction cup and a next one of the stacked sheets, thereby to separate remaining sheets of the stacked sheets from the uppermost sheet.

The device further includes detecting means for detecting whether the suction cup attracts a single sheet, the detecting means comprising a detecting rod for abutting against the uppermost sheet attracted by the suction cup, and a sensor energizable by the detecting rod.

The above and other objects, features and advantages of the present invention will become more apparent from the following description when taken in conjunction with the accompanying drawings in which preferred embodiments of the present invention are shown by way of illustrative example.

DETAILED DESCRIPTION OF THE PREFERRED EMBODIMENTS

Figure 1:
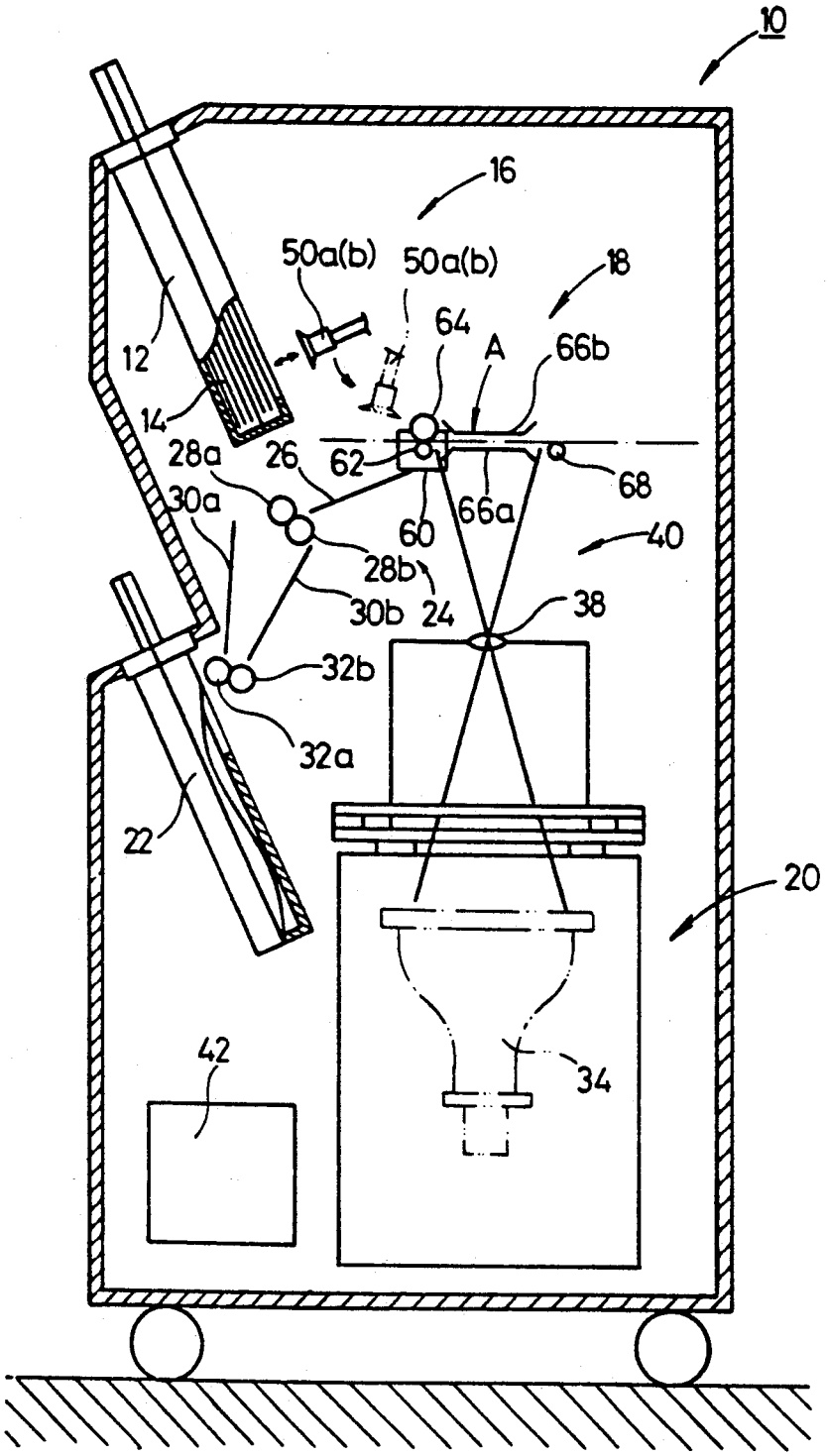
FIG. 1 is a schematic vertical cross-sectional view of an image recording system which incorporates a sheet feeding device according to a first embodiment of the present invention.

FIG. 1 shows an image recording system 10 which incorporates a sheet feeding device according to a first embodiment of the present invention, for feeding photographic photosensitive mediums in the form of sheets, one by one. The image recording system 10 mainly comprises a sheet feeding device 16 according to the first embodiment for taking out stacked unexposed photographic photosensitive mediums 14 stored in a supply magazine 12, a delivery device 18 for delivering the photographic photosensitive medium 14 taken out of the supply magazine 12 into an exposure position A, an exposure device 20 for exposing the photographic photosensitive medium 14 to image information or the like, and a conveying mechanism 24 for delivering the exposed photographic photosensitive medium 14 into a receiver magazine 22 where it is stacked.

The conveying mechanism 24 includes a guide plate 26 for guiding the exposed photographic photosensitive medium 14 delivered by the delivery device 18, a pair of guide plates 30*a*, 30*b* positioned downstream of the guide plate 26 with respect to the path of the photographic photosensitive medium 14 toward the receiver magazine 22, a pair of drive rollers 28*a*, 28*b* for sending the photographic photosensitive medium 14 from the guide plate 26 to the guide plates 30*a*, 30*b*, and a pair of drive rollers 32*a*, 32*b* for sending the photographic -photosensitive medium 14 from the guide plates 30*a*, 30*b* into the receiver magazine 22.

The exposure device 20 has a CRT display unit 34 for displaying image information, and an optical system 38 for exposing the photographic photosensitive medium 14 to the displayed image information through a focusing lens 38.

The CRT display unit 34 and the optical system 40 are vertically movable in FIG. 1 into a position where the photographic photosensitive medium 14 in the exposure position A can be exposed to desired image information.

The sheet feeding device 16, the delivery device 18, the conveying mechanism 24, and the exposure device 20 have respective electric circuits which are controlled by a controller 42 including a microcomputer that is disposed in the casing of the image recording system 10.

Figure 2:
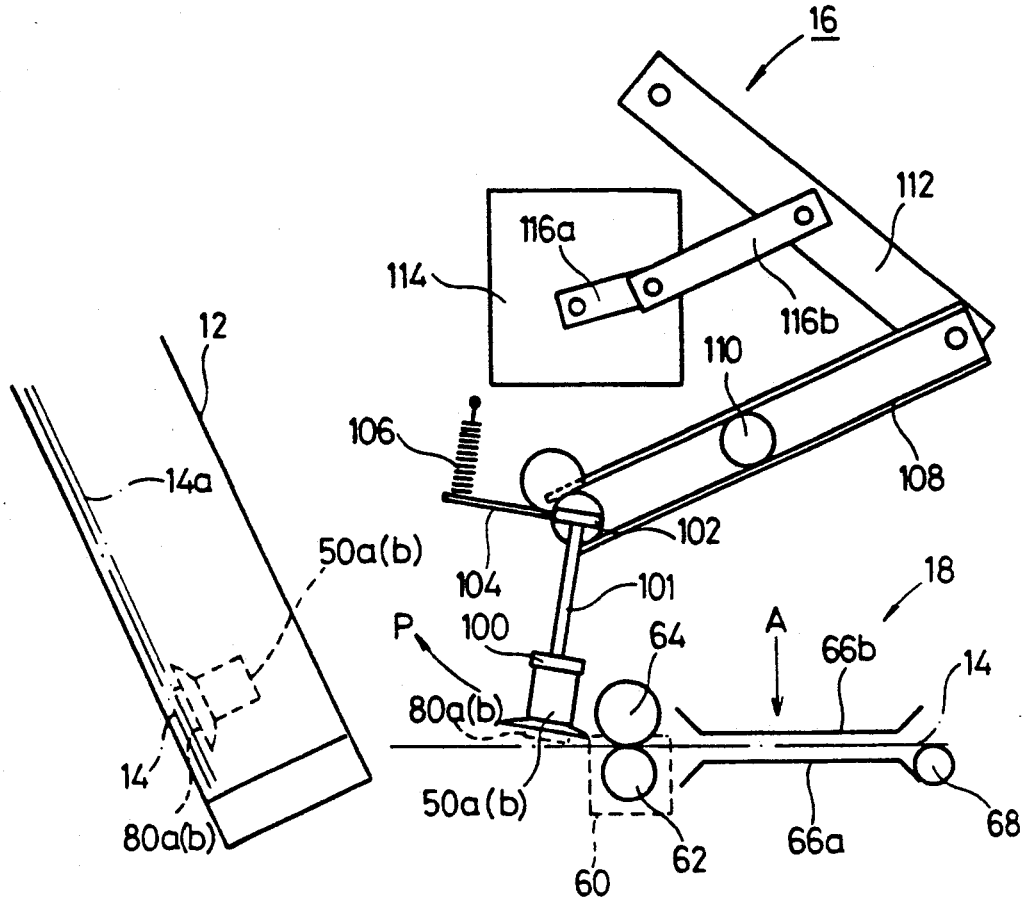
FIG. 2 is an enlarged schematic side elevational view of the sheet feeding device shown in FIG. 1.

As shown in FIGS. 1 and 2, the sheet feeding device 16 has a pair of suction cups 50*a*, 50*b* for holding and feeding a photographic photosensitive medium 14 from the supply magazine 12 to the delivery device 18. The delivery device 18 has a drive roller 62 connected to a step motor 60 through a coupling or the like (not shown) and rotatable by the step motor 60, and a driven roller 64 disposed in confronting relation to the drive roller 62, for gripping the photographic photosensitive medium 14 in coaction with the drive roller 62. The photographic photosensitive medium 14 is delivered by the drive and driven rollers 62, 64 while being gripped therebetween, and guided toward a delivery roller 68 by a pair of guide plates 66*a*, 66*b*. The delivery roller 68 may be rotated by a belt (not shown) which is trained around the rollers 62, 68. The photographic photo-sensitive medium 14 thus delivered is positioned in the exposure position A.

Figure 3:
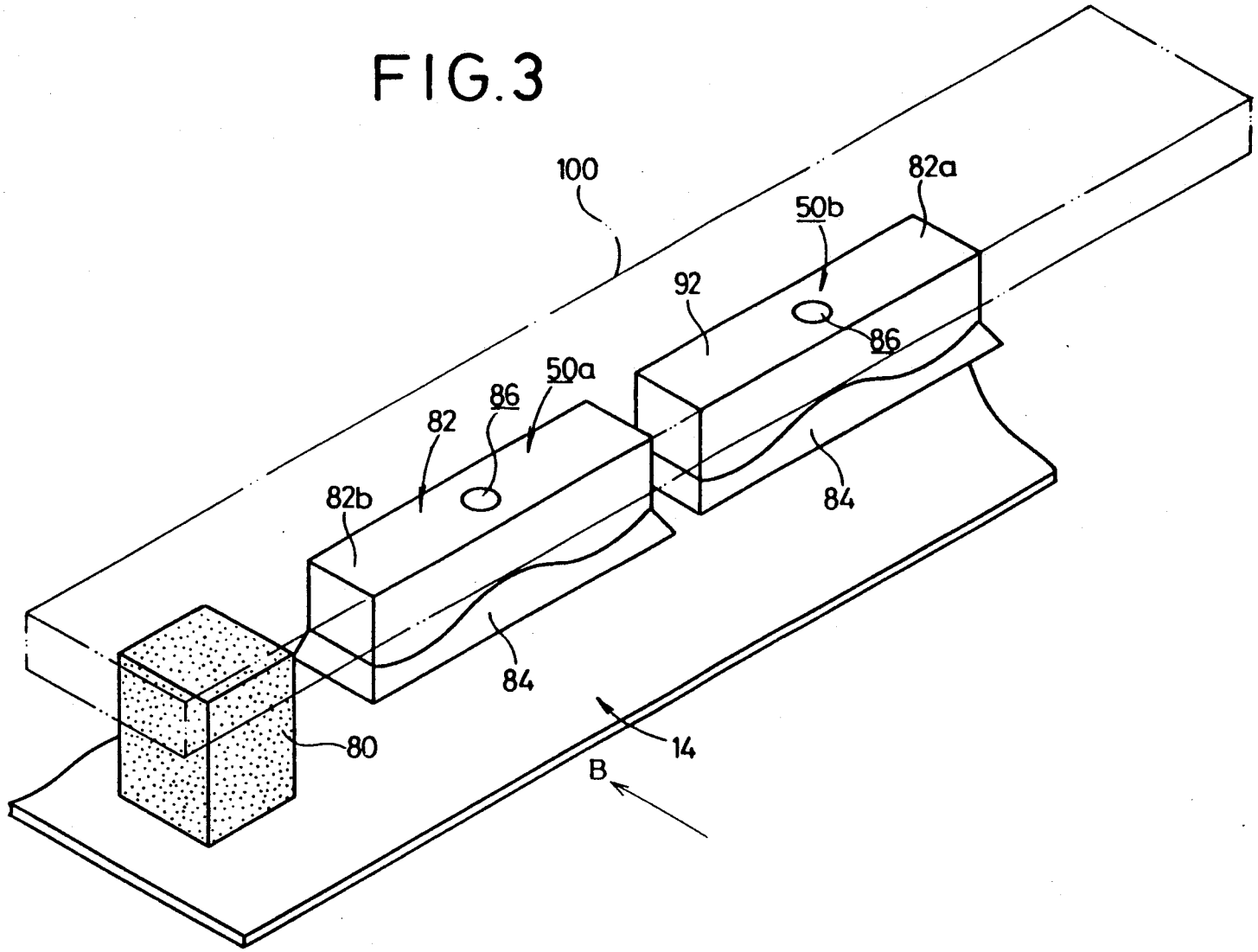
FIG. 3 is an enlarged fragmentary perspective view of the sheet feeding device shown in FIG. 2.

As shown in FIG. 3, the sheet feeding device 16 also has a sheet separator 80 disposed outwardly of the suction cup 50*a*, the sheet separator 80 being made of a resilient material such as sponge. Each of the suction cups 50*a*, 50*b* comprises an inflexible hollow base 82 substantially in the shape of a rectangular parallelepiped, and a flexible suction skirt 84 joined to the lower end of the base 82. The base 82 has an opening 86 defined therein and opening at an upper surface 82*a* thereof. The opening 86 is connected to a vacuum valve (not shown) which draws air from within each of the suction cups 50*a*, 50*b*. The lower end of the base 82 has a wavy surface to which the upper edge of the suction skirt 84 is joined. The lower edge of the suction skirt 84 is flat in its free state. The wavy surface of the lower end of the base 82 causes a photographic photosensitive medium 14 to be curved when the photographic photosensitive medium 14 is drawn to the suction cups 50*a*, 50*b* so that the photographic photosensitive medium 14 can reliably be fed from the remaining stack of photographic photosensitive mediums 14.

The base 82 has a wall thickness large enough not to be deformed while the suction cups 50*a*, 50*b* are drawing a photographic photosensitive medium 14 under suction. The thickness of the suction skirt 84 is small enough to be easily elastically deformed in conformity with the wavy lower surface of the base 82 while a photographic photosensitive medium 14 is being drawn by the suction cups 50*a*, 50*b*. For example, the base 82 should have a wall thickness of about 5 mm and the suction skirt 84 should have a thickness of about 1 mm.

The base 82 and the suction skirt 84 are not limited to particular materials. However, it is preferable that the base 82 be made of a metallic material such as aluminum, stainless steel, or the like, or a plastic material such as vinyl chloride, acrylic resin, or the like, and that the suction skirt 84 be made of a flexible material such as natural rubber, urethane rubber, neoprene, silicone rubber, or the like. The base suction skirt 84 may be bonded to the base 82 by an adhesive.

As shown in FIG. 2, the suction cups 50*a*, 50*b* and the sheet separator 80 are mounted on an arm 100 from which there extends a rod 101 having an end angularly movably attached to a guide 108 through a plate 102. The sheet separator 80 is positioned such that it can abut against an end of a photographic photosensitive medium 14 to be fed. Preferably, the sheet separator 80 should be displaceable with respect to the arm 100 so that the sheet separator 80 can be positioned at an end of a photographic photosensitive medium 14 to be fed.

A plate 104 is fixed to and projects from the plate 102 and has a distal end to which one end of a coil spring 106 is fixed, the other end of the coil spring 106 being secured to a frame or the like (not shown). The suction cups 50*a*, 50*b* are normally urged to turn in the direction indicated by the arrow P (FIG. 2) under the bias of the coil spring 106.

The guide 108 is supported by a support 110 substantially at a longitudinally central position on the guide 108. The guide 108 is operatively coupled to an arm 112 which is in turn operatively coupled to a motor 114 such as a step motor through links 116*a*, 116*b*. The arm 112, the links 116*a*, 116*b*, and the guide 108 jointly constitute a link mechanism for converting rotation of the motor 114 into sheet feeding movement of the suction cups 50*a*, 50*b*.

The sheet feeding device 16 is basically constructed as described above. Now, operation and advantages of the sheet feeding device 16 will be described below.

When the motor 114 is energized, the link mechanism moves the suction cups 50*a*, 50*b* toward the photographic photosensitive mediums 14 stacked in the supply magazine 12. The arm 100 is displaced to cause the suction cups 50a, 50b to approach the uppermost photographic photosensitive medium 14a while a vacuum is being developed in the suction cups 50a, 50b.

Figure 4A:
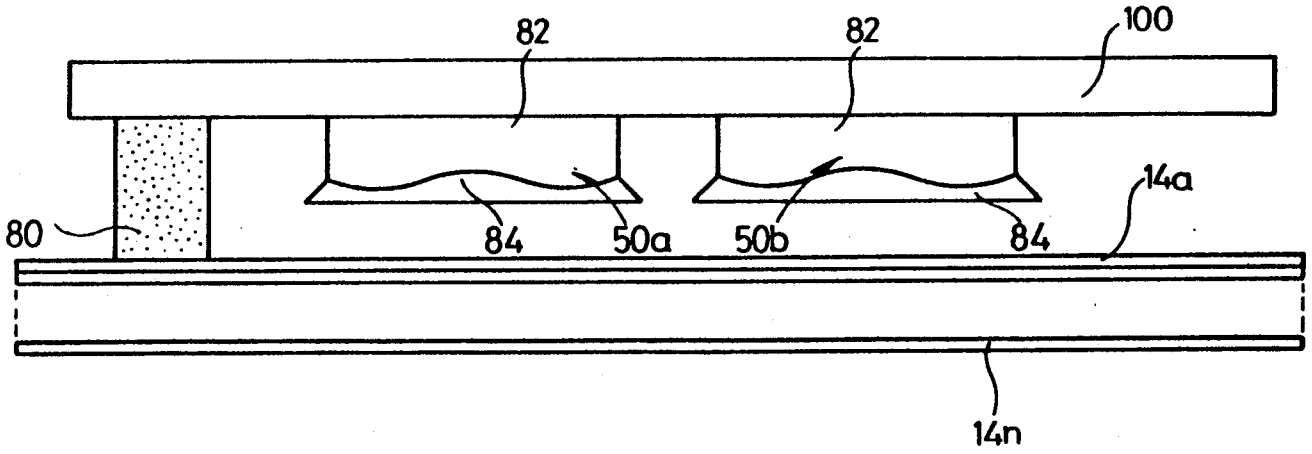
FIGS. 4*a* through 4*c* are views illustrative of the manner in which the sheet feeding device shown in FIG. 3 operates.
Figure 4B:
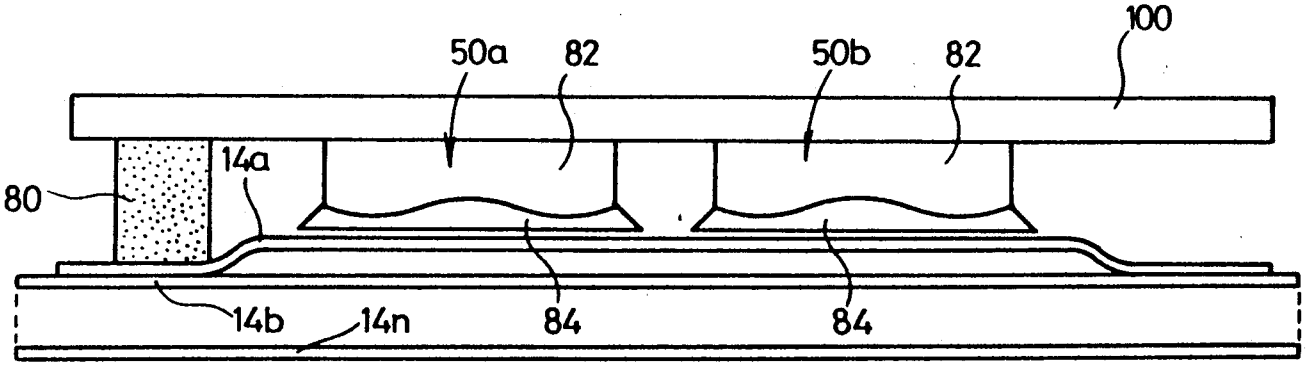

When the arm 100 reaches a predetermined position, the sheet separator 80 abuts against the surface of the uppermost photographic photosensitive medium 14a as shown in FIG. 4a. Since the sheet separator 80 is made of a relatively soft elastic material such as sponge, it does not damage the surface of the photographic photosensitive medium 14a. The arm 100 is further displaced to press the sheet separator 80 against the photographic photosensitive medium 14a and also to displace the suction cups 50a, 50b toward the photographic photosensitive medium 14a. Upon arrival of the suction cups 50a, 50b at a certain position with respect to the photographic photosensitive medium 14a, the suction cups 50a, 50b attracts and holds the photographic photosensitive medium 14a under suction even before the suction cups 50a, 50b are moved into abutment against the photographic photosensitive medium 14a. As a result, as shown in FIG. 4b, the photographic photosensitive medium 14 is flexed between the suction cups 50a, 50b and the sheet separator 80. Because the sheet separator 80 is held against an end of the photographic photosensitive medium 14a, the photographic photosensitive medium 14a can easily be flexed at the end held by the sheet separator 80. When the photographic photosensitive medium 14ais attracted by the suction cups 50a, 50b under suction, the vacuum developed in the suction cups 50a, 50b is detected by a sensor (not shown), and the displacement of the suction cups 50a, 50b toward the photographic photosensitive medium 14a is stopped in response to a detected signal from the sensor.

Figure 4C:
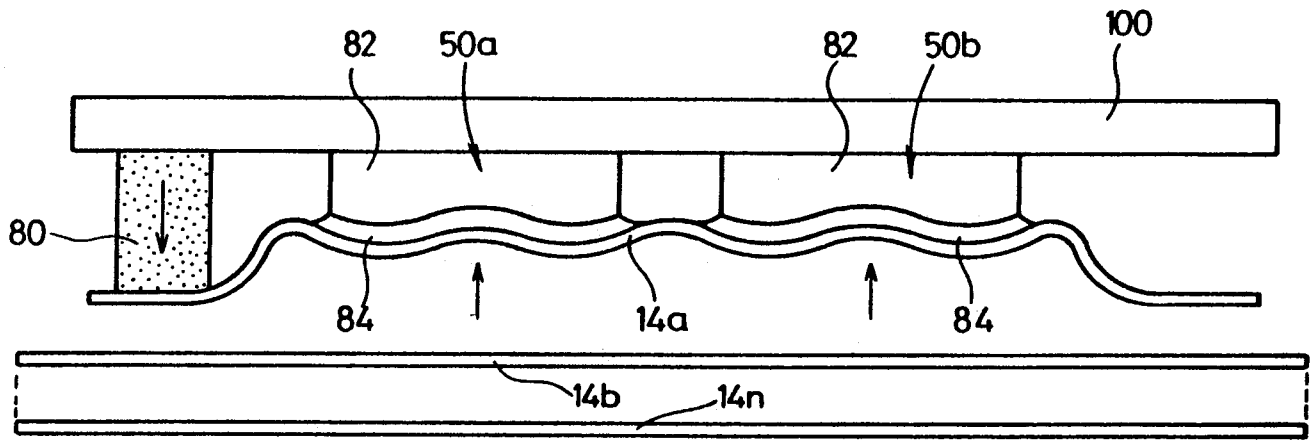

Then, the arm 100 is moved back to displace the sheet feeding device 16 away from the supply magazine 12. The sheet separator 80 is then expanded under its own resiliency to flex the end of the photographic photosensitive medium 14a in a direction away from the arm 100. At this time, the suction skirts 84 of the suction cups 50a, 50b are held against the photographic photosensitive medium 14a. Therefore, the photographic photosensitive medium 14a is more flexed because of the resilient force applied to the end thereof by the separator 80 in a direction to push the photographic photosensitive medium 14a away from the arm 100 and the suction force applied to the photographic photosensitive medium 14a by the suction cups 50a, 50b in a direction to pull the photographic photosensitive medium 14 toward the arm 100, as shown in FIG. 4c. Consequently, air is introduced between the uppermost photographic photosensitive medium 14a and the next photographic photosensitive medium 14b in a direction normal to the sheet of FIG. 4c (i.e., in a direction indicated by the arrow B in FIG. 3). The next photographic photosensitive medium 14b is thus completely separated from the photographic photosensitive medium 14a. The motor 114 is further energized to feed the photographic photosensitive medium 14a toward the exposure position A.

Figure 5:
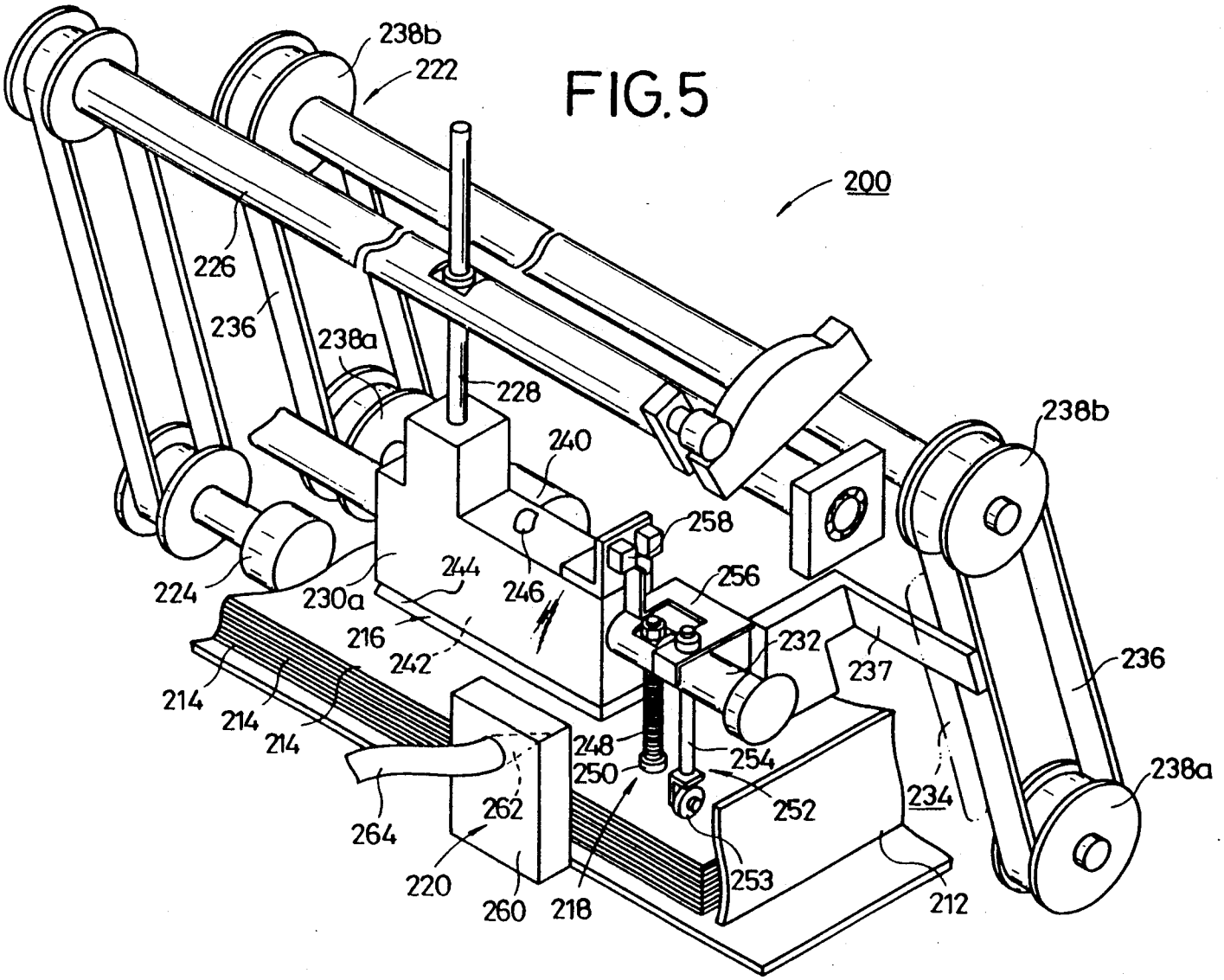
FIG. 5 is a perspective view of a sheet feeding device according to a second embodiment of the present invention.

FIGS. 5, 6, and 7a through 7c show a sheet feeding device 200 according to a second embodiment of the present invention. As shown in FIG. 5, the sheet feeding device 200 feeds exposed photographic photosensitive mediums 214 with image recorded thereon, one by one, to an automatic photographic processor (not shown). The sheet feeding device 200 comprises a pair of suction cups 216 (see FIGS. 7a through 7c) for successively attracting and holding exposed photographic photosensitive mediums 214 stacked in a supply magazine 212, a sheet separator 218 for resiliently abutting against an end of each photographic photosensitive medium 214 as it is to be fed, and an air blower 220 for supplying air between the photographic photosensitive medium 214 held by the suction cup 216 and a next photographic photosensitive medium 214 therebelow.

Figure 7A:
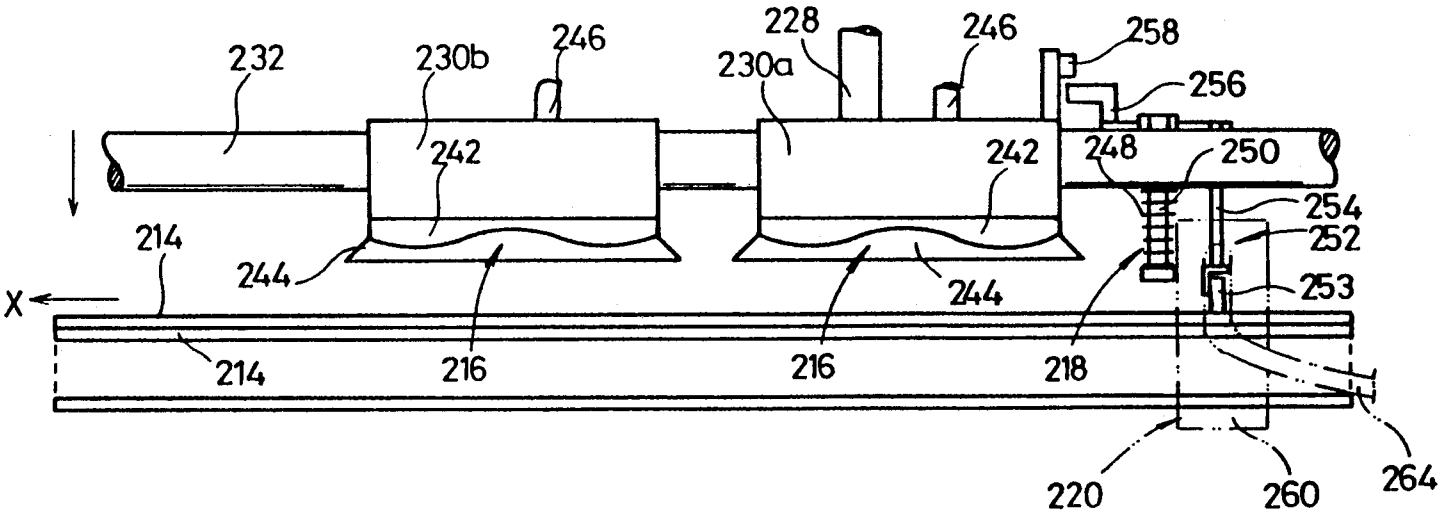
FIGS. 7*a* through 7*c* are views showing the manner in which the sheet feeding device shown in FIG. 6 operates.
Figure 7B:
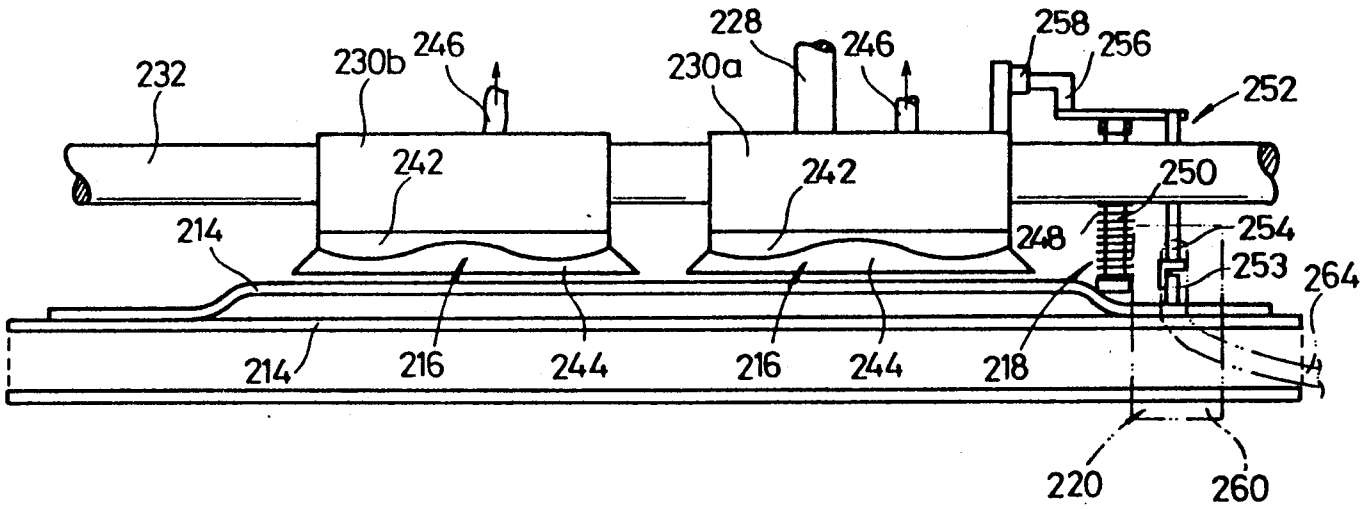
Figure 7C:
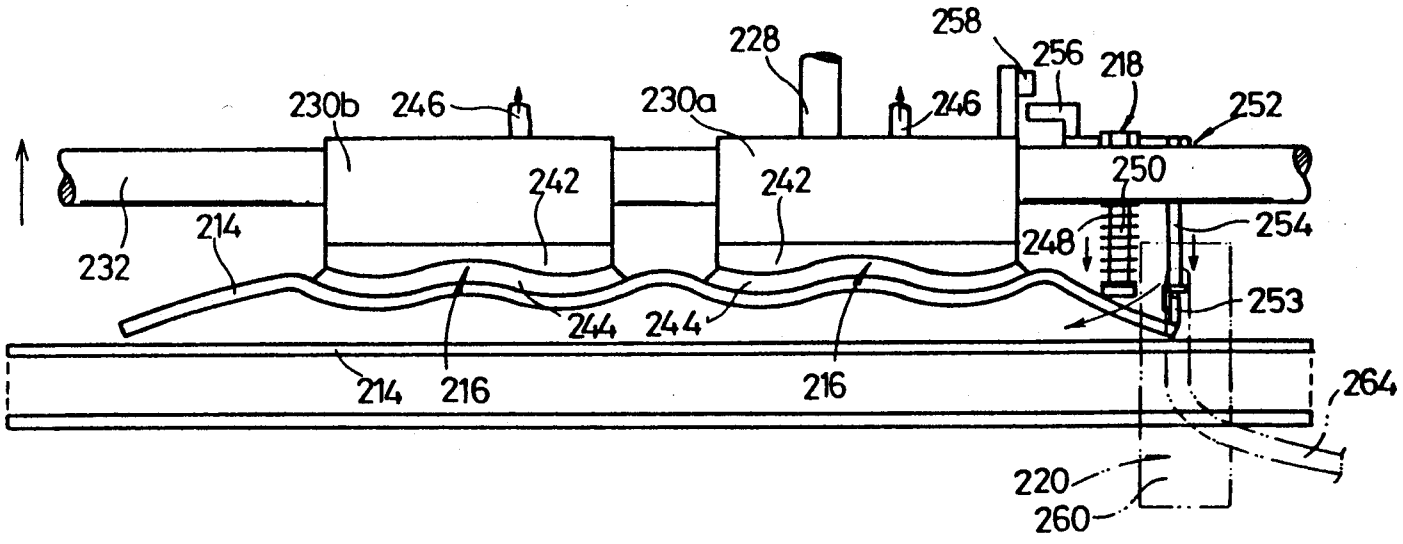

The suction cups 216 and the sheet separator 218 are displaceable in unison with each other by a drive mechanism 222. The drive mechanism 222 has a rotative drive source 224 such as a motor which is operatively coupled to a rotatable shaft 226. Through the rotatable shaft 226, there is diametrically inserted a guide bar 228 with a holder 230a fixedly mounted on an end thereof. The holder 230a and another holder 230b are supported on a rod 232 disposed below the shaft 226, as shown in FIGS. 7a through 7c.

The rod 232 has opposite ends engaging respective engaging members 237 which have ends inserted through respective guide grooves 234 and fixed to respective belts 236. The belts 236 are trained around respective pairs of pulleys 238a, 238b, with one of the pulleys 238a being coupled to a rotative drive source 240 such as a motor.

The suction cups 216 are mounted on the respective holders 230a, 230b. Each of the suction cups 226 comprises an inflexible hollow base 242 substantially in the shape of a rectangular parallelepiped, and a flexible suction skirt 244 joined to the lower end of the base 242. The lower end if the base 242 has a wavy surface to which the upper edge of the suction skirt 244 is joined. The lower edge of the suction skirt 244 is normally flat. The wavy surface of the lower end of the base 242 causes a photographic photosensitive medium 214 to be curved when the photographic photosensitive medium 214 is drawn to the suction cups 216 so that the photographic photosensitive medium 214 can reliably be fed from the remaining stack of photographic photosensitive mediums 214. The base 242 has a wall thickness large enough not to be deformed while the suction cups 216 are drawing a photographic photosensitive medium 214 under suction. The thickness of the suction skirt 244 is small enough to be easily elastically deformed in conformity with the wavy lower surface of the base 242 while a photographic photosensitive medium 214 is being drawn by the suction cups 216. Tubes 246 have ends connected to a vacuum valve (not shown) and the other ends fixed to the holders 230a, 230b in communication with the suction cups 216.

The sheet separator 218 has a rod 250 axially movably supported on the rod 232. The rod 250 is normally urged to move toward the stacked photographic photosensitive mediums 214 under the bias of a coil spring 248 disposed around the rod 250.

The rod 232 supports a detector 252 positioned near the sheet separator 218, for detecting whether a single photographic photosensitive medium 214 is attracted and held by the suction cups 216. The detector 252 comprises a detecting rod 254 axially movably supported on the rod 232 and having on its distal end a roller 253 for engaging the photographic photosensitive medium 214 which is attracted and held by the suction cups 216, and an optical sensor 258 fixed to the holder 230a and energizable by a plate 256 connected to the other end of the detecting rod 254.

The air blower 220 has a fixed member 260 disposed near the sheet detecting 218 at ends of photographic photosensitive mediums 214 and located a certain vertical position. A nozzle 262 is supported at a certain angle on the fixed member 260, and coupled to a tube 264 communicating with a source of air (not shown).

Figure 6:
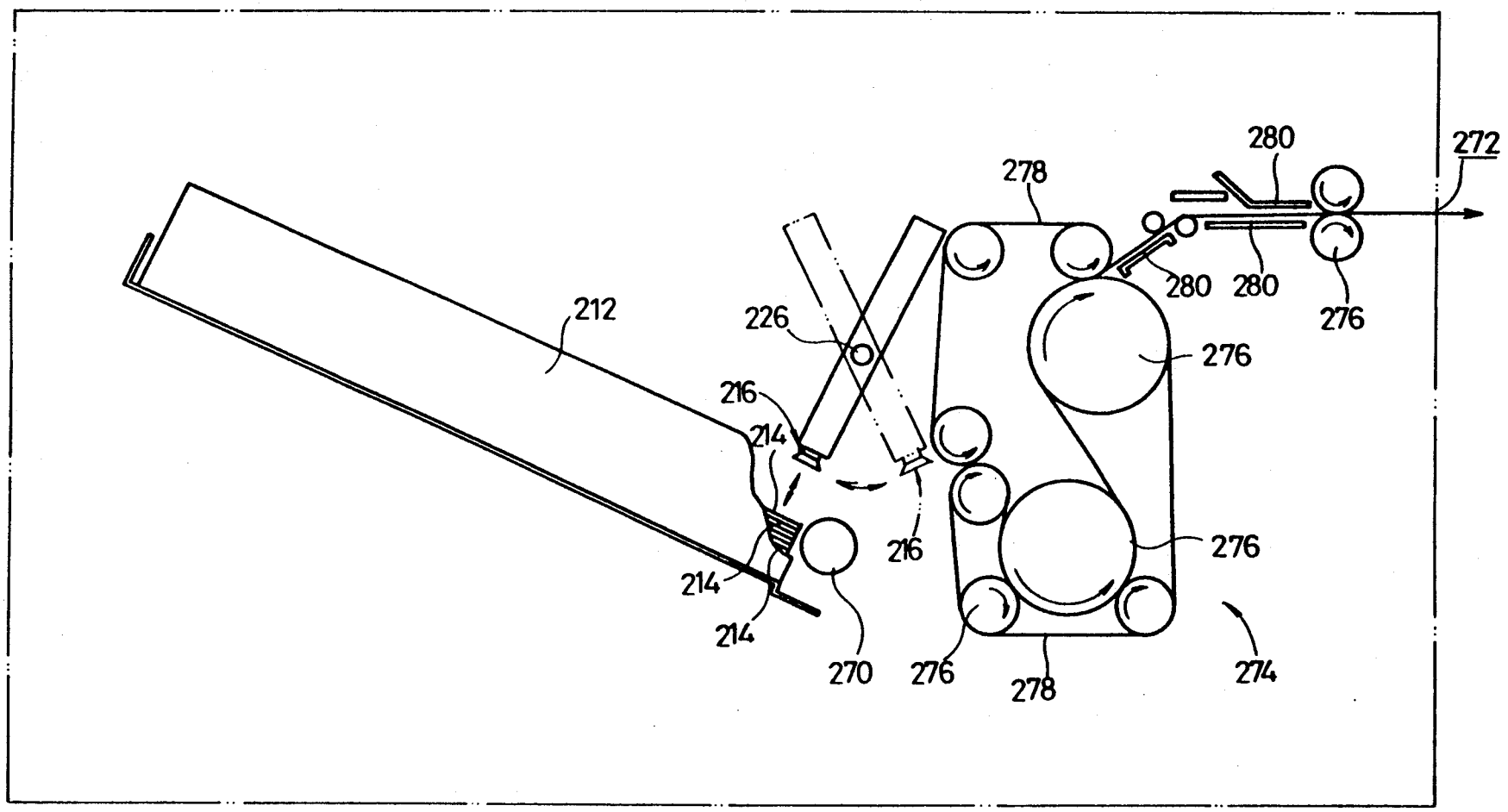
FIG. 6 is a schematic vertical cross-sectional view of the sheet feeding device shown in FIG. 5.

As shown in FIG. 6, a guide roller 270 is disposed in the vicinity of the supply magazine 212. A conveying mechanism 274 for conveying a photographic photosensitive medium 214 taken out from the supply magazine 212 toward an outlet slot 272 is also disposed near the guide roller 270.

The conveying mechanism 274 has a plurality of rollers 276 and belts 278 trained around the rollers 276. In the conveying mechanism 274, a photographic photosensitive medium 214 is first directed downwardly and then upwardly by the rollers 276 and the belts 278. Thereafter, the photographic photosensitive medium 214 is horizontally delivered from the conveying mechanism 274 through guide plates 280, and delivered from the outlet slot 272 toward the automatic photographic processor.

The sheet feeding device 200 thus constructed operates as follows:

After the supply magazine 212 is loaded in the sheet feeding device 210 and opened therein, the rotative drive source 240 is energized to cause the pulleys 238*a*, 238*b*, the belts 236, and the engaging members 237 to displace the rod 232 toward the supply magazine 212. The rod 250 of the sheet separator 218 and the detecting rod 254 of the detector 252 are brought into abutment against an end of the uppermost photographic photosensitive medium 224 in the supply magazine 212, and the suction cups 216 approach the uppermost photographic photosensitive medium 214 (see FIG. 7*a*).

The detecting rod 254 is displaced upwardly with respect to the rod 232, enabling the plate 256 on the detecting rod 254 to activate the optical sensor 258, whereupon the arrival of the suction cups 216 at a predetermined position with respect to the photographic photosensitive medium 214 is detected.

At a certain vertical position, the suction cups 216 start drawing the uppermost photographic photosensitive medium 214 before they abut against the photographic photosensitive medium 214. The suction cups 216 now attract and hold the photographic photosensitive medium 214 under suction. As a result, as shown in FIG. 7*b*, the photographic photosensitive medium 214 held by the suction cups 216 is flexed between the suction cups 216 and the sheet separator 218. When the photographic photosensitive medium 214 is attracted by the suction cups 216 under suction, the vacuum developed in the suction cups 216 is detected by a sensor (not shown), and the displacement of the suction cups 216 toward the photographic photosensitive medium 214 is stopped in response to a detected signal from the sensor.

Then, the rotative drive source 240 is reversed to move the rod 232 away from the supply magazine 212. The rod 250 of the sheet separator 218 pushes the end of the photographic photosensitive medium 214 toward the supply magazine 212 under the bias of the coil spring 248, flexing the photographic photosensitive medium 214 to a greater degree at its end as shown in FIG. 7*c*.

Air is then ejected from the nozzle 262 of the air blower 220, and introduced between the uppermost photographic photosensitive medium 214 held by the suction cups 216 and the next photographic photosensitive medium 214 therebeneath. The next photographic photosensitive medium 214 is thus completed separated from the uppermost photographic photosensitive medium 214, and left in the supply magazine 212.

With the single photographic photosensitive medium 214 held by the suction cups 216, the end of the photographic photosensitive medium 214 is flexed downwardly by the sheet separator 218. Therefore, the detecting rod 254 abutting against the flexed end of the photographic photosensitive medium 214 is lowered, allowing the plate 256 to be lowered away from the optical sensor 258, which detects that the single photographic photosensitive medium 214 is attracted and held by the suction cups 216.

If two or more photographic photosensitive mediums 214 are attracted and held by the suction cups 216, since these photographic photosensitive mediums 214 have a greater degree of combined rigidity, the end of the photographic photosensitive mediums 214 is not lowered as much as when only one photographic photosensitive medium 214 is held by the suction cups 216. Therefore, the detecting rod 254 remains too high to move the plate 256 away from the optical sensor 258. The optical sensor 258 thus detects that the suction cups 216 attract and hold two or more photographic photosensitive mediums 214 under suction. In this case, the suction cups 216 are vertically moved again to separate the other photographic photosensitive medium or mediums 214 from the uppermost photographic photosensitive medium 214. In this manner, the photographic photosensitive mediums 214 can reliably and efficiently be fed from the supply magazine 212 one by one.

When the suction cups 216 reach a predetermined position upon continued operation of the rotative drive source 240, the rotative drive source 240 is de-energized, and the rotative drive source 224 is energized to cause the shaft 226 to turn the rod 232 in a given angular range for thereby feeding the photographic photosensitive medium 214 attracted and held by the suction cups 216 toward the conveying mechanism 274.

The suction cups 216 are now inactivated, releasing the photographic photosensitive medium 214. The photographic photosensitive medium 214 is first delivered downwardly and then upwardly by the rollers 276*b* and the belts 278, and thereafter guided horizontally through the guide plates 280. Then, the photographic photosensitive medium 214 is delivered from the outlet slot 272 toward the automatic photographic processor (not shown).

In the second embodiment, the uppermost one of the stacked photographic photosensitive mediums 214 in the supply magazine 212 is drawn up by the suction cups 216, and the rod 250 of the sheet separator 218 resiliently abuts against the end of the photographic photosensitive medium 214 under the bias of the coil spring 248. When the suction cups 216 are displaced by the holders 230*a*, 230*b* which are moved by the rotative drive source 240, the end of the photographic photosensitive medium 214 is flexed by the rod 250 abutting thereagainst. The next photographic photosensitive medium 214 is then reliably separated from the uppermost photographic photosensitive medium 214 by air which is introduced from the air blower 220 into the space between the uppermost and next photographic photosensitive mediums 214. Accordingly, a plurality of photographic photosensitive mediums 214 are prevented from being simultaneously fed to the conveying mechanism 274.

It is preferable that the air supplied from the nozzle 262 be directed slightly obliquely downwardly with respect to the horizontal direction for effective separation of the next photographic photosensitive medium 214 from the uppermost photographic photosensitive medium 214.

The detector 252 can easily and accurately detect whether the suction cups 216 hold a single photographic photosensitive medium 214 or not. If a plurality of photographic photosensitive mediums 214 are attracted and held by the suction cups 216, as detected by the detector 252, then the suction cups 216 are lifted and lowered again to leave only the uppermost photographic photosensitive medium 214 on the suction cups 216. Accordingly, the photographic photosensitive mediums 214 can quickly be fed one by one from the supply magazine 212.

If photographic photosensitive mediums 214 of a different size, particularly a large size, are employed, the ends of these photographic photosensitive mediums 214 (in the direction indicated by the arrow X in FIG. 7*a*), which are not attracted by the suction cups 216, tend to hang down greatly particularly at the leading side of the photographic photosensitive mediums 214. However, the guide roller 270 disposed near the supply magazine 212 can hold the ends of the photographic photosensitive mediums 214 that are not attracted by the suction cups 216, so that the photographic photosensitive mediums 214 can reliably be delivered to the conveying mechanism 274 even if they are of a large size.

With the present invention, when stacked photographic photosensitive mediums such as photographic films are fed one by one by the suction cups, the suction cups are not directly pressed against the stacked photographic photosensitive mediums. Therefore, air is apt to remain between the stacked photographic photosensitive mediums, preventing the photographic photosensitive mediums from being fed together at the same time.

The sheet separator is disposed outwardly of the suction cups in the vicinity of ends of the photographic photosensitive mediums. When the photographic photosensitive mediums are fed one by one, the sheet separator and the suction cups apply oppositely directed forces to the photographic photosensitive mediums, so that the uppermost photographic photosensitive medium held by the suction cups is greatly flexed out of contact with the next photographic photosensitive medium. As a result, a plurality of photographic photosensitive mediums are prevented from being simultaneously taken from the supply magazine. Since the suction cups are not directly pressed against the photographic photosensitive mediums, the photographic photosensitive mediums are prevented from being fogged or reduced in photosensitivity at local regions thereof. An experiment conducted using the image recording system which incorporates the sheet feeding device according to the present invention indicated that the cycle to feed a photographic photosensitive medium from the supply magazine with the sheet feeding device of the invention was about 5 seconds whereas the cycle ranged from 7 to 8 seconds with the conventional sheet feeding device, and hence one cycle to record an image on a photographic photosensitive medium was greatly reduced.

The sheet separator employed in the sheet feeding device according to the first embodiment may be made of natural rubber, urethane rubber, neoprene, silicone rubber, or the like, rather than sponge, or may be in the form of another resilient element such as a coil spring whose distal end is processed not to damage the surface of photographic photosensitive mediums. While only one sheet separator is employed in each of the above embodiments, two sheet separators may be provided symmetrically one on each side of the suction cups. In the illustrated embodiments, the uppermost photographic photosensitive medium to be fed from the supply magazine is not turned or swung out of contact with the next photographic photosensitive medium. However, the uppermost photographic photosensitive medium may be turned or swung when it is taken out of the supply magazine so that a plurality of photographic photosensitive mediums will not be fed simultaneously.

While the lower end of the base of each of the suction cups in the above embodiments has a wavy surface, it may have a flat surface.

The suction cups in the above embodiments may be replaced with usual frustoconical suction cups.

The principles of the present invention may also be applied to a high-speed automatic sheet feeder for use in a photographic photosensitive medium processing system.

Moreover, the uppermost photographic photosensitive medium is forcibly flexed out of the next photographic photosensitive medium by the suction cups and the sheet separator, leaving a space between these photographic photosensitive mediums. When air is introduced into such a space from the air blower, the next and lower photographic photosensitive mediums are reliably be separated from the uppermost photographic photosensitive medium which is attracted and held by the suction cups. Consequently, a plurality of photographic photosensitive mediums or sheets are prevented from being taken out simultaneously from the supply magazine. The photographic photosensitive mediums or sheets are thus efficiently and automatically fed one by one from the supply magazine.

Although certain preferred embodiments have been shown and described, it should be understood that many changes and modifications may be made therein without departing from the scope of the appended claims.

What is claimed is:

1. A device for feeding sheets one by one, comprising:

a suction cup for attracting an uppermost one of stacked sheets;

sheet separating means for contacting an end of the uppermost sheet and separating the uppermost sheet from the remaining sheets, said sheet separating means comprising pushing means for pushing an end of said uppermost sheet so as to flex the end of said uppermost sheet downwardly toward said stacked sheets;

detecting means, disposed separately from said pushing means, for detecting whether said suction cup attracts a single sheet, said detecting means comprising a rod for abutting against the end of said uppermost sheet while the end is flexed downwardly by said pushing means, and a sensor operable by said detecting rod depending on a degree of flexure of said uppermost sheet, and support means for supporting at least said suction cup and said detecting means, wherein said suction cup and said detecting means are commonly supported thereon and are moved in unison by said support means.

* * * * *